United States Patent [19]

Yang

[11] Patent Number: 4,681,315

[45] Date of Patent: Jul. 21, 1987

[54] DUMBBELL WITH DOUBLE COVER HAND PROTECTOR AND GRASPING TRAINING FUNCTION

[76] Inventor: Tai-Her Yang, 5-1 Taipin St., Si-Hu Town, Dzan-Hwa, Taiwan

[21] Appl. No.: 748,848

[22] Filed: Jun. 26, 1985

[51] Int. Cl.[4] ..... A63B 11/08

[52] U.S. Cl. ..... 272/122; 272/67; 272/140; 272/143

[58] Field of Search ..... 272/122, 123, 93, 135, 272/140, 68, 67, 143

[56] References Cited

U.S. PATENT DOCUMENTS

| | | | |
|---|---|---|---|
| 677,824 | 7/1901 | Troxler, Jr. | 272/68 |
| 708,242 | 9/1902 | Moseley | 272/68 |
| 742,393 | 10/1903 | Chellis et al. | 272/122 X |
| 789,538 | 5/1905 | Ham | 272/122 X |
| 965,284 | 2/1910 | Dossetter | 272/122 X |
| 1,026,215 | 5/1912 | Korth | 272/122 X |
| 2,814,491 | 11/1952 | Proctor | 272/122 X |
| 4,021,040 | 5/1977 | Inoue | 272/68 X |
| 4,192,500 | 3/1980 | Crow et al. | 272/68 |
| 4,569,105 | 2/1986 | Weider | 272/123 X |

FOREIGN PATENT DOCUMENTS

| | | | |
|---|---|---|---|
| 11388 | 5/1911 | United Kingdom | 272/68 |

*Primary Examiner*—Richard J. Apley
*Assistant Examiner*—Robert W. Bahr
*Attorney, Agent, or Firm*—Leonard Bloom

[57] ABSTRACT

An exercising device is provided with hand grips, being positioned between a pair of torsion springs and carried by a dumbbell are eccentric to the weight of the dumbbell which allows gripping exercises to be performed independently of the dumbbell and which also allows gripping exercises to be performed simultaneous with raising and lowering of the drumbbell. This structure provides an "anti-throw out" guard when the user thereof is performing simultaneous gripping and lifting actions, such as is common in modern aerobic exercises. The device includes an elongated weight bar having reduced end portions which carry weight members and a resilient torsion spring member. The resilient torsion spring member has first and second torsion springs which are positioned substantially parallel to each other for receiving the respective reduced end portions of the weight bar therethrough. Each torsion spring has a pair of spring legs extending therefrom, and a rod is positioned between, and integrally formed with, a respective spring leg in each pair of torsion springs. In a preferred embodiment, a pair of protective covers are annularly disposed on a respective rod member.

6 Claims, 5 Drawing Figures

DUMBBELL WITH DOUBLE COVER HAND PROTECTOR AND GRASPING TRAINING FUNCTION

BACKGROUND OF THE INVENTION

This is a design aims at the safety and training ability of dumbbell to improve its protective purpose and to enhance its training function. A set of the same axis with ring like spring on both side and the middle part is a stripe-framing structure fixed with ring like matters for grasping training purpose. Such structure will provide training function for grasping and also will protect the back part of hands of the users.

SUMMARY OF THE INVENTION

The dumbbell for training purpose usually has one cover for hand protection which is not sufficient for protection purpose and it is easily thrown out during the strong motion. This design has double cover for hand protection to offer more protective so to prevent throwing out and it also serves as grasping training.

BRIEF DESCRIPTION OF THE DRAWINGS

FIG. 1-1—A combination of the structure of the design.

DETAILED DESCRIPTION OF THE INVENTION

Dumbbell is popularly used for training the muscle and better used more recently for rhythmic exercise. The conventional dumbbell is easily to cause harm to others when it is throwing out due to careless or to the users hand back. The additional function for grasping training will save time for people who are so busy in modern living.

This design is aimed at the above requirement. The main point is to construct a set of ring like spring on both side of the same axis with stripe-framing structure in the middle part to serve grasping exercise as well as protection of hand backs. The example is shown in the FIG. 1.

Figure 1:
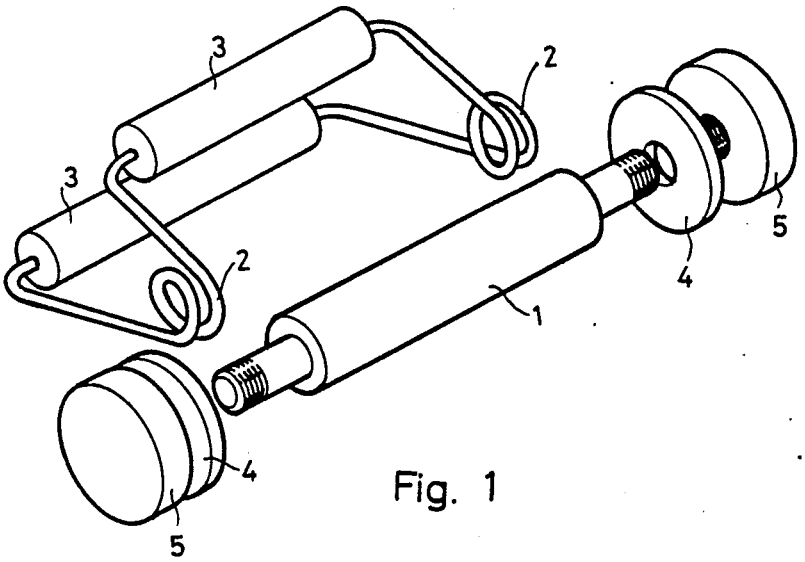
FIG. 1—An analytical drawing of the design.
Figure 1:
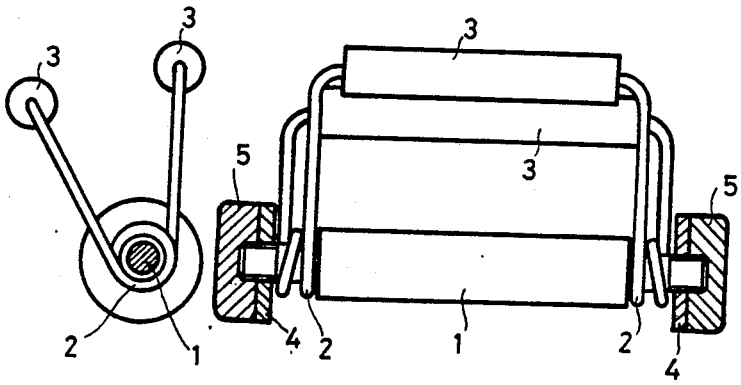

In the FIG. 1, both end of the axis shaft or weight bar (1) are screw-shaped for connecton of stripe-framing ring like spring (or resilient torsion spring member) (2) and protecting cover (3) with weight selecting round block (4) and weights (5) of thread hole on both ends. FIG. 1-1 indicating the combination idea.

The selecting block can serve as fixed weight riveted with axis shaft (1) for one side or one part or integrated by other means for easy production purpose.

Figure 2:
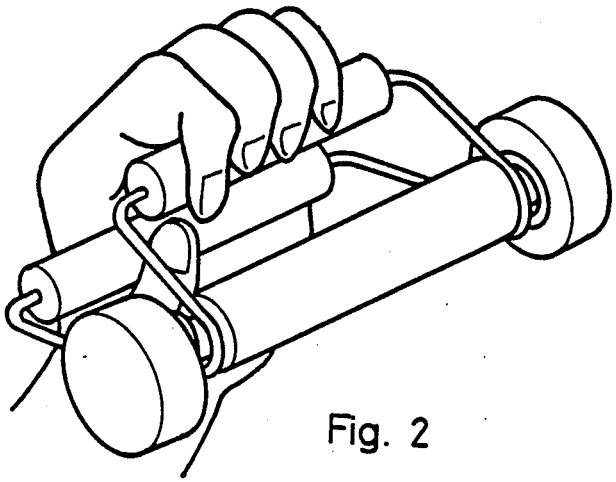
FIG. 2—Demonstration drawing for grasping exercise of the design.

The new designed dumbbell functions include:

Used for grasping training as shown in FIG. 2 and further coordinated with the inward or outward motion by grasping when moving outward and loosening when moving inward to serve as wrist, breast and shoulder exercises.

Figure 3:
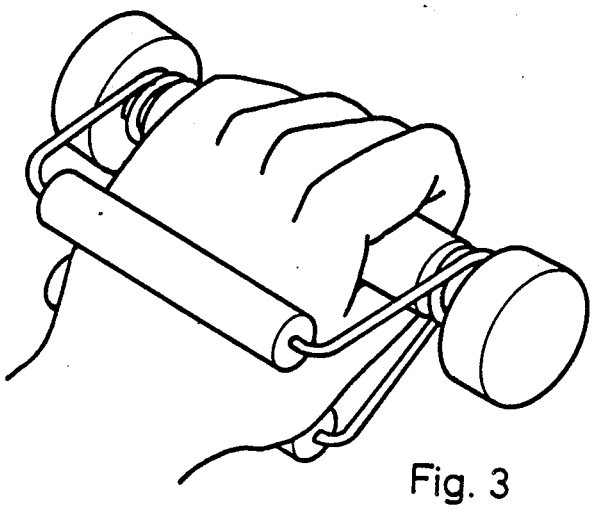
FIG. 3—Demonstration drawing for rhythmic exercise of the design.
Figure 4:
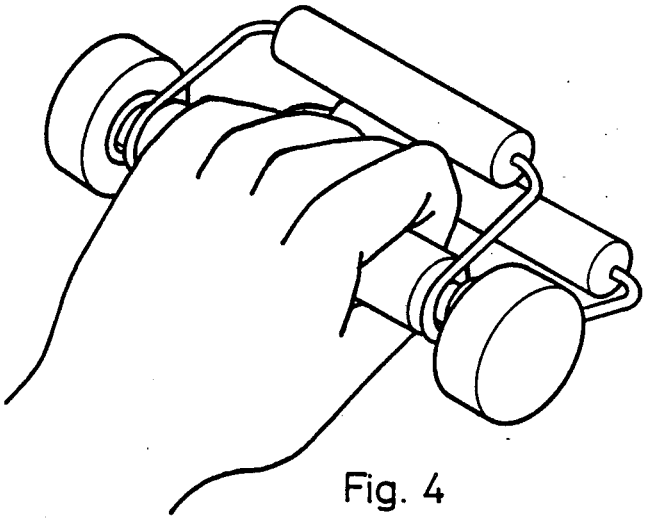
FIG. 4—Demonstration drawing for conventional use of the design.

Used as rhythmic moving as shown in FIG. 3, fit in from the wrist for double cover with hand backs to prevent throwing out.

Used as conventional dumbbell exercise by the protection double cover to protect the users.

From the above, this design as compared with the single cover of conventional dumbbell is more functional and protective to the users.

I claim:

1. An exercising device comprised, in combination, of: an elongated weight bar having reduced portions at each end thereof, thereby defining an annular shoulder on the weight bar, each of said reduced end portions being threaded; a resilient torsion spring member having first and second torsion springs, said torsion springs being positioned substantially parallel to one another for receiving a respective said reduced end portion of the bar therethrough, such that each of said springs is received against a respective annular shoulder, said first and second torsion springs each having a pair of spring legs extending therefrom, said spring member further having a pair of rod members, each of said rod members being positioned between, and integrally formed with, a respective spring leg of each torsion spring, said rod members being further positioned on substantially parallel axes to one another; and at least two weight members, each having a threaded aperture formed therein for engaging a respective threaded portion of the weight bar, thereby securing the respective weight member to the bar.

2. The device of claim 1, being further comprised of a pair of protective covers, each of said covers being annularly disposed on a respective rod member of the resilient tension spring.

3. The device of claim 1, wherein each weight member comprises at least two weight selecting blocks, each having an aperture formed substantially centrally therethrough for engaging and being secured on a respective said reduced end portion, thereby retaining said first and second torsion springs against said respective shoulders.

4. The device of claim 3, further having a plurality of weight selecting blocks of varying weights for being selectively disposed on the device in response to the users desires.

5. The device of claim 3, wherein the aperture formed in each of the weight selecting block is threaded.

6. An exercising device comprised of: an elongated weight bar having reduced portions at each end thereof; each reduced portion defining an annular shoulder, each of said reduced end portions further being threaded; a resilient torsion spring member having first and second torsion springs, said torsion springs being positioned substantially parallel to one another for receiving a respective said reduced end portion of the bar therethrough, such that each of said springs is received against a respective annular shoulder; said first and second torsion springs each having a pair of spring legs extending therefrom, said spring member further having a pair of rod members, each of said rod members being positioned between, and integrally formed with, a respective spring leg of each torsion spring, said rod members being further positioned on substantially parallel axes to one another; at least two weight members, each having a threaded aperture formed therein for engaging and securing a respective threaded portion of the weight bar therein; a pair of respective protective covers, each of said covers being annularly disposed on a respective rod member of the resilient tension spring; at least two weight selecting blocks each having a threaded aperture formed substantially centrally therethrough for engaging and being secured on a respective said end portion in a position between a respective said torsion coil and weight member, whereby said block is securely held in place.

* * * * *